US010646018B2

(12) United States Patent
Moretti

(10) Patent No.: US 10,646,018 B2
(45) Date of Patent: May 12, 2020

(54) WIPER DEVICE

(71) Applicant: LUMSON S.p.A., Capergnanica (CR) (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 0 days.

(21) Appl. No.: 16/181,553

(22) Filed: Nov. 6, 2018

(65) Prior Publication Data

US 2019/0133297 A1 May 9, 2019

(30) Foreign Application Priority Data

Nov. 7, 2017 (IT) ..... 102017000126683

(51) Int. Cl.
*A45D 34/04* (2006.01)
*A45D 40/26* (2006.01)

(52) U.S. Cl.
CPC ..... *A45D 34/046* (2013.01); *A45D 34/043* (2013.01); *A45D 40/264* (2013.01); *A45D 40/267* (2013.01); *A45D 2200/05* (2013.01)

(58) Field of Classification Search
CPC .. A45D 34/046; A45D 34/043; A45D 34/042; A45D 34/045; A45D 34/047; A45D 40/264; A45D 40/267; A45D 40/262; A45D 40/254; A45D 40/268; A45D 2200/05
See application file for complete search history.

(56) References Cited

U.S. PATENT DOCUMENTS 5,697,720 A 12/1997 Lhuisset
7,186,044 B2 * 3/2007 Bailly ..... A45D 40/267 132/218
2014/0016983 A1 1/2014 Kim
2014/0234007 A1 * 8/2014 Lee ..... A45D 34/00 401/121

FOREIGN PATENT DOCUMENTS

FR 2679425 A1 1/1993
FR 2897761 A1 8/2007

OTHER PUBLICATIONS

Search Report and Written Opinion dated May 4, 2018 for Italian patent application No. 102017000126683.

* cited by examiner

*Primary Examiner* — David J Walczak
(74) *Attorney, Agent, or Firm* — Vorys, Sater, Seymour and Pease LLP

(57) ABSTRACT

A wiper device of a blown container, including a hollow body having a first and a second end defining respectively a first and a second opening, a flange extending from an outer surface of the hollow body at the first end, and a wiper element extending from an inner surface of the hollow body, the wiper element defining a passage with a smaller section than the first and second openings. The hollow body features at least two localized swellings for fastening the wiper device onto the container. The localized swellings extending as protrusions from the outer surface of the wiper, near the second end of the hollow body.

19 Claims, 2 Drawing Sheets

WIPER DEVICE

CROSS REFERENCE TO RELATED APPLICATION

This claims the benefit of Italian patent application no. 102017000126683, filed Nov. 7, 2017, hereby incorporated by reference in its entirety.

FIELD OF THE INVENTION

The present invention relates to a wiper device.

In particular, it refers to a wiper device for dropper pipettes, mascara brushes, lip gloss brushes, or nail polish brushes, to be associated with containers made of blown glass or plastic.

BACKGROUND ART

In the cosmetics field and in the medical field, there are commonly known containers inside which there is a fluid to be dispensed. The said fluid may be an anti-wrinkle solution, a fluid for the face or body, or products for the cosmetics and make-up market, such as foundation, lip gloss, liquid lipstick, mascara, concealer, primer for eyes, and primer for lips.

These containers are equipped with a cap for sealing.

In certain applications, in order to allow the extraction and effective and localised use of the fluid from inside the bottle, the cap is associated with a dropper, which is equipped with an elastic element at the top thereof. When the elastic element is pressed, an overpressure is created inside the dropper (and in particular inside an element thereof called a pipette), which leads to the expulsion of the product contained within the pipette.

Upon releasing the pressure on the elastic element, a vacuum is created inside the pipette which, if the pipette is immersed in the fluid, allows the suction thereof into the pipette, thus preparing the fluid for a subsequent dispensing thereof.

Since the pipette is immersed in the fluid during use, the pipette is wet externally and may drip in an undesired manner during use, thus changing the dose of the product dispensed. This is not tolerable and therefore, in the most advanced systems, what is known as a 'wiper' is associated with the bottle opening, which cleans the exterior of the pipette simultaneously upon extraction thereof from the bottle.

In other applications, a stem is applied to the cap, with a semi-rigid element fastened to one end thereof, the said applicator concentrating the product in a particular position and allowing the localised application thereof. Different applicator configurations allow different areas of application, with the possibility of diversifying the texture as well.

The wipers according to prior art are very simple and usually comprise a tubular element which is fastened, by interference fit, to a mouth of the container. Internally, the tubular element provides a passageway with a smaller section, which is sized according to the external dimension of the pipette. Therefore, when the pipette is moved within the passageway with a smaller section, the liquid present externally thereto stops on the wiper element, then falls back into the container.

The wiper devices according to prior art are made of plastic. When the said devices must be coupled to a plastic container, also made of injection blow moulded plastic or injection stretch blow moulded plastic, one simply has to carefully scale the coupling tolerance so as to obtain a good seal between the wiper element and the container and a stable, long-lasting positioning of the wiper within the container.

This is due to the fact that, during production of plastic containers with the technologies described above, the dimensional tolerance which can be achieved at the mouth of the container is very good, and therefore no further modifications are necessary in order to achieve secure fastening of the wiper device.

When, however, the container where the wiper is to be applied is made of glass or plastic shaped using the conventional blow moulding technique, the matter becomes more complicated, as the dimensional tolerances achieved when blowing glass and plastic are not as good as those achieved with the techniques discussed earlier.

As a result, it is not possible to fasten a wiper element stably using conventional methods to a blown glass or plastic container. Or rather, it is not possible to stably fasten a wiper to all glass or plastic containers originating from the same production batch.

This is because, in some containers, the mouth is wider than that 'tolerated' by the wiper element, and over time the wiper element tends to slide out of the container mouth. This is not acceptable because, as is known, the containers produced by blowing are destined for a high-end market, where product quality must remain at the maximum level over time.

SUMMARY OF THE INVENTION

The object of the present invention is to provide a wiper device which may be fastened to the mouth of a blown container in a more stable manner than with those according to prior art.

A further object of the invention is to provide a wiper device which may also be fastened in a stable manner to blown glass or plastic containers, which are made, therefore, with less stringent tolerances than those obtainable with other processes.

This and other objects are achieved by means of a wiper device according to the technical teachings of the claims annexed hereto.

BRIEF DESCRIPTION OF THE FIGURES

Further characteristics and advantages of the invention will become clearer in the description of a preferred but not exclusive embodiment of the device, illustrated—by way of a non-limiting example—in the drawings annexed hereto, in which.

DETAILED DESCRIPTION OF THE INVENTION

With reference to the figures stated, reference number 1 is used to denote, as a whole, a wiper device.

The wiper device 1 is configured to be inserted into a container 20 made of blown plastic or blown glass.

Figure 6:
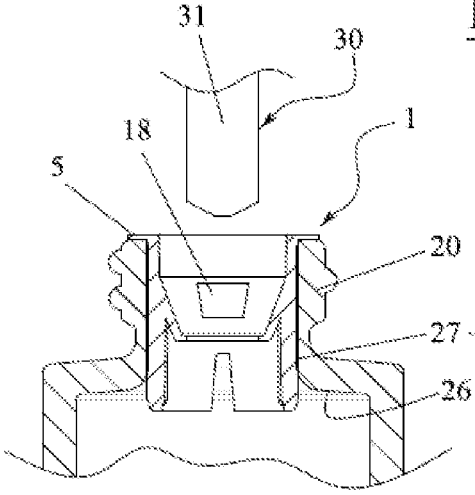
FIGS. 6 and 7 are simplified sections taken, respectively, along lines III-III and IV-IV in FIG. 2, when the wiper is inserted in the mouth of a container.

Inside the container 20, there is a fluid to be dispensed or metered out by means of a dropper 30, equipped with a pipette 31 (FIG. 6).

The wiper device 1 comprises a hollow body 2 having a first 3 and a second end 4 defining respectively a first 3A and a second opening 4A. At the first end, there is a flange present, which extends from an outer surface 2A of the hollow body 2.

Then, there is a wiper device 6 present, which extends from an inner surface 2B of the hollow body 2.

Figure 1:
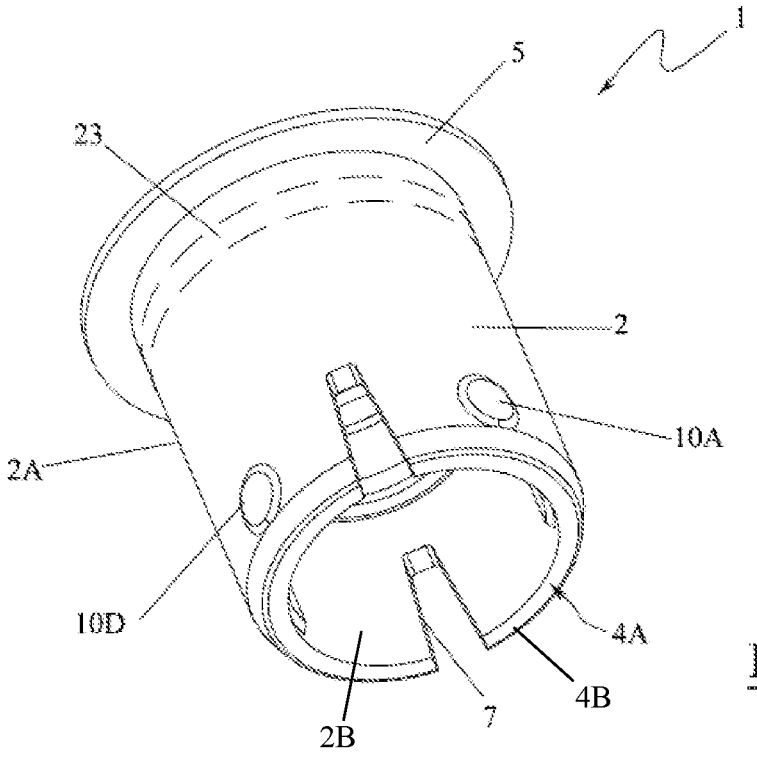
FIG. 1 is a bottom-up perspective view of a wiper device according to the present invention.

As can be seen from FIG. 1, the wiper element 6 comprises a frustoconical surface 6B converging towards the second end 4A of the hollow body; the frustoconical surface defines a passage 6A with a smaller section than that of the first and second openings 3A 4A.

Figure 7:
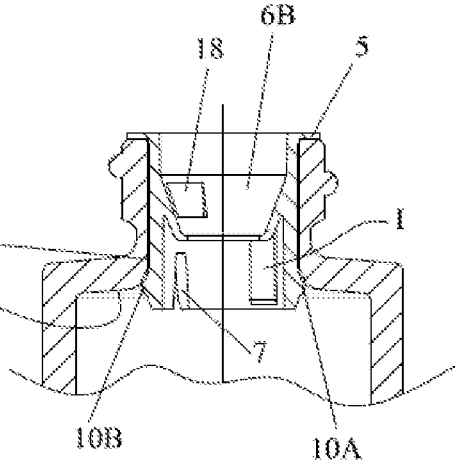

To fasten the wiper device to a neck of a glass container 20, as seen in FIGS. 6 and 7, the hollow body 2 features at least two localized swellings 10A, 10B.

The localized swellings 10A, 10B extend from the outer surface 2A of the wiper into an area close to the second end 4, and in particular into a band (with height h1) included between the second end 4 of the hollow body and the wiper element 6.

Each localized swelling 10A, 10B, 10C, 10D may have a drop shape which extends partially from the outer surface of the hollow body.

Preferably, the localized swellings have a spherical cap shape, which protrudes from the outer surface of the hollow body.

Indeed, the presence of swellings which are localized, and therefore concern solely a limited portion of the perimeter of the outer surface of the hollow body, causes the ovalization thereof during the stage in which the said body is inserted into the container and the relaxation thereof and return to an essentially circular configuration once insertion is complete, as can be seen in FIG. 7.

Figure 2:
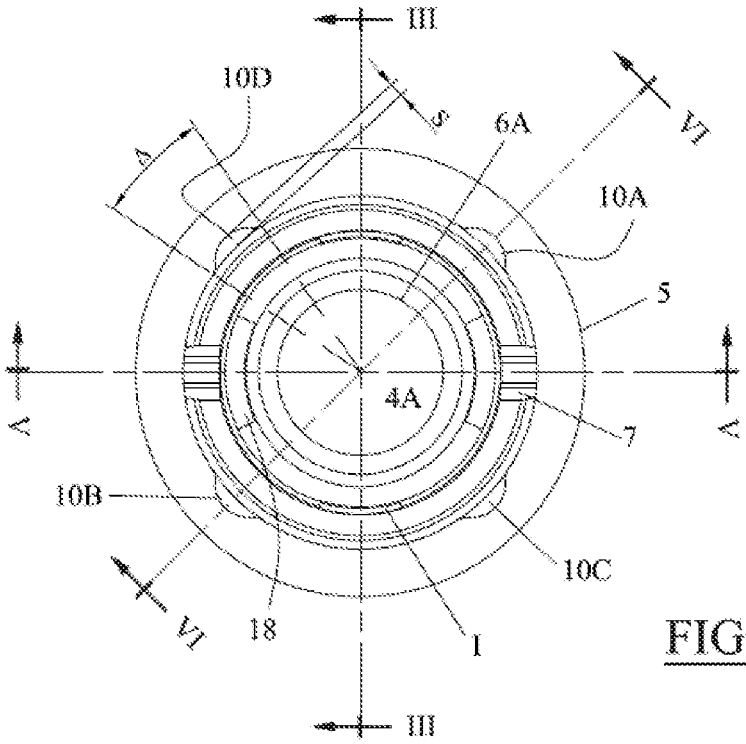
FIG. 2 is a bottom-up plan view of the wiper device in FIG. 1.

As can be seen in FIG. 2, the angular magnitude Δ of each swelling may be comprised between 5° and 30°.

To improve elastic deformability of the hollow body during insertion thereof into the container, the latter comprises at least one open window 7 on a free edge 4B of said second end 4. Advantageously, at least two diametrically facing windows are provided.

Figure 3:
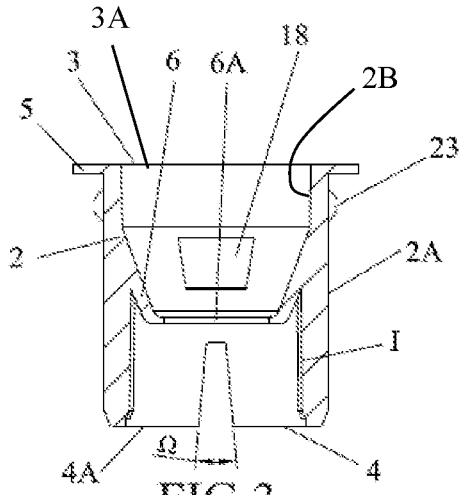
FIGS. 3, 4, and 5 are sections taken, respectively, along lines III-III, IV-IV, and V-V in FIG. 2.
Figure 4:
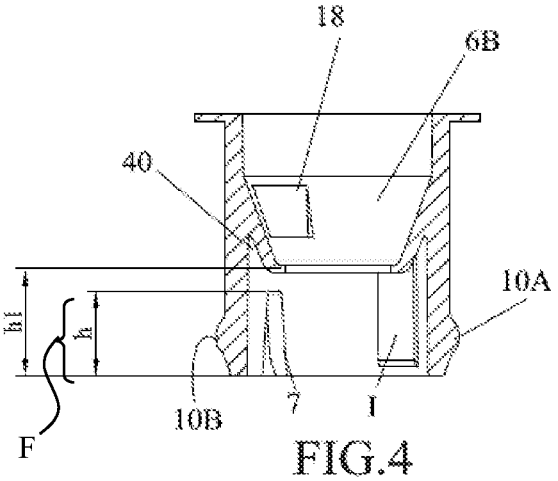
Figure 5:
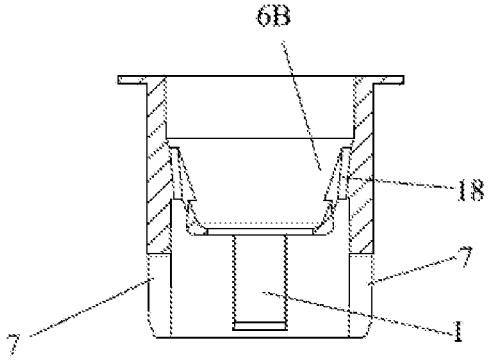

As can be seen in FIG. 3, each window 7 may have inclined walls, advantageously inclined by an angle Ω comprised between 5° and 20°.

In this case, the localized swellings 10A, 10B, 10C, 10D are at least partially positioned within a band F on the outer surface where the at least one window 7 is also positioned, said band F having a height h equal to the height of at least one window 7.

The maximum height S of the swellings may be comprised between 0.5 and 2 mm.

The presence of the window in correspondence with the swellings increases the elastic deformability of the hollow body, thereby improving the grip of the wiper device on the glass, as well as the ease of insertion of the wiper device into the neck of the container.

Advantageously, as can be seen in the figures, there are at least two diametrically facing windows 7 and/or four localized swellings 10A, 10B, 10C, 10D, which are arranged in diametrically facing pairs.

The four localized swellings maybe spaced at 90° angles.

Furthermore, the at least one window 7 and the at least one localized swelling 10A, 10B may be spaced. This means that the at least one window 7 is not directly adjacent to the localized swelling 10A, 10B.

Preferably, the at least one window 7 and the at least one localized swelling 10A, 10B are spaced of an angle comprised between 20° and 45°, preferably of an angle of 45°.

This arrangement of the windows and the swellings optimises both the insertion and the seal of the wiper inside the container.

To facilitate the moulding of the wiper device, which is preferably made as a single piece of plastic material, at least one rib I or protrusion may be present on the inner surface of the hollow body 2, which may be positioned at a 90° angle from the window. Therefore, there are two protrusions.

Such protrusions considerably facilitate the injection moulding of the wiper device.

To complete the description, it should be noted that the wiper element 6 features at least one peripheral opening 18, preferably made in the frustoconical surface 6B of the said wiper element, which is suitable for the passage of the residues of a wiped fluid. Preferably there are two openings present, which are aligned with the windows 7 and diametrically facing.

Furthermore, as can be seen in FIG. 6, the outer surface of the wiper is configured to be inserted, in an air-tight way, into the mouth of a container. Therefore the diameter of the outer surface of the wiper will be slightly greater and will be inserted, with an interference fit, into the mouth of the container, thus forming a seal.

Advantageously, there may be at least one perimetral protrusion 23 (highlighted with a dashed line only in FIGS. 1 and 3) on the external surface of the hollow body (below the flange, or better, between the flange and the passage section 6A of the wiper) preferably with a sealing ring conformation (or rather a 'semi-ring').

As already mentioned, the wiper device 1 may be made by injection moulding plastic and forming a single piece.

Some plastics suitable for the production of the wiper device include: PP-LDPE-PE-HDPE-PA-RUBBER-TPU-TPE-SILICONE.

The operation of the wiper device 1 disclosed above is clear to a person skilled in the art and is essentially as follows.

The wiper device 1 is pushed forcibly into the opening of a container made of glass, designed to contain a cosmetic or medical product.

During insertion, the presence of the localized swellings which come into contact with the surface of the container defining the opening leads to an ovalization of the hollow body.

It should be noted that the swellings are located within a 'lower' band of the hollow body, far away from the wiper element, and such flexing does not concern the opening 6A thereof, which therefor remains in the original form.

If the windows 7 are present, deformation is easier.

When the localized swellings reach a portion of the neck 26 of the container 20 which converges towards the opening of the container 20, the hollow body 2 expands elastically back into its essentially circular configuration, thus securing the wiper device 1 in position.

More specifically, said portion of the neck of the container corresponds to the connection between a shoulder 26 of the container and the neck 27.

A pipette 31 (of a dropper 30) may thus be used to withdraw the fluid contained within the container.

The opening 6A of the wiper is sized so as to wipe the external surface of the pipette 31, in practice cleaning the wiper of any residual fluid present on the exterior thereof.

In addition, any product residues located in the upper part of the wiper, towards the first ends of the hollow body, fall back into the container through the openings 18 described above, made in the frustoconical surface of the wiper element.

The positioning of the wiper element passage section 6A at the end of the frustoconical surface, and therefore 'separate' from the walls of the hollow body 2, safeguards the shape and size of the said wiper device, even in the event that the hollow body 2 is subjected to pressure exerted by the neck of the container against the external surface thereof.

Regarding this, there is an annular space 40 which 'isolates' the inner wall of the hollow body from the wiper passage 6A surface, safeguarding said hollow body from any deformation and from the transmission of stresses.

Various embodiments of the innovation have been disclosed herein, but further embodiments may also be conceived using the same innovative concept.

The invention claimed is:

1. A wiper device of for a blown glass or plastic container, comprising:

a hollow body having a first and a second end defining respectively a first and a second opening, a flange extending from an outer surface of the hollow body at the first end, and a wiper element extending from an inner surface of the hollow body, the wiper element defining a passage of a section smaller than that of the first and second openings, wherein the hollow body comprises at least two localized swellings for fastening the wiper device to the container, each said localized swelling extending from an outer surface of the wiper device in proximity of the second end of the hollow body, at least one said hollow body comprising at least one open window at a free edge of said second end, the localized swelling being at least partially located in a band of the outer surface where also the at least one open window is located, said band having a height equal to a height of said open window, the at least one open window and at least one said localized swelling being angularly spaced, the at least one localized swelling being configured to lead to ovalization of the hollow body during a stage in which the hollow body is inserted into the container and relaxation thereof and return to an essentially circular configuration once insertion is complete.

2. The wiper device according to claim 1, wherein the at least one open window and at least one localized swelling are angularly spaced of an angle comprised between 20° and 45°.

3. The wiper device according to claim 1, wherein there are two diametrically-facing open windows.

4. The wiper device according to claim 3, wherein the four localized swellings are angularly spaced by 90°.

5. The wiper device according to claim 1, wherein the inner surface of the hollow body has at least one rib.

6. The wiper device according to claim 5, wherein the rib is angularly spaced from the window by 90°.

7. The wiper device according to claim 1, wherein at least one of the localized swellings has a drop shape.

8. The wiper device according to claim 1, wherein the wiper element comprises at least one opening made on a frustoconical surface at one end of which the passage of the wiper element is placed, the opening being configured to drain residues of a wiped fluid.

9. The wiper device according to claim 1, wherein the outer surface of the wiper device is configured to form a seal when coupled to a mouth of a container.

10. The wiper device according to claim 1, wherein the outer surface of the hollow body has, formed in one piece, at least one protruding sealing ring positioned outside said band.

11. The wiper device according to claim 1, wherein the at least one window and at least one localized swelling are angularly spaced of an angle comprised 45°.

12. The wiper device according to claim 1, wherein the localized swelling is a protrusion.

13. The wiper device according to claim 1, wherein the localized swelling is a dome-shaped protrusion.

14. The wiper device according to claim 1, wherein there are four diametrically-facing localized swellings.

15. The wiper device according to claim 1, wherein there are two diametrically-facing open windows, and wherein four localized swellings are present diametrically-facing two by two.

16. The wiper device according to claim 1, wherein at least one of the localized swellings has a spherical cap shape.

17. The wiper device according to claim 1, wherein at least one of the localized swellings has a drop shape, and at least one of the localized swellings has a spherical cap shape.

18. The wiper device according to claim 1, wherein the hollow body and the wiper are formed to define a single piece.

19. The wiper device according to claim 1, wherein the at least two localized swellings are positioned along the band exterior the at least one open window.

* * * * *